US005732688A

United States Patent [19]

Charlton et al.

[11] Patent Number: 5,732,688

[45] Date of Patent: Mar. 31, 1998

[54] SYSTEM FOR CONTROLLING RECIRCULATED EXHAUST GAS TEMPERATURE IN AN INTERNAL COMBUSTION ENGINE

[75] Inventors: Steve J. Charlton; Leslie A. Roettgen, both of Columbus, Ind.

[73] Assignee: Cummins Engine Company, Inc., Columbus, Ind.

[21] Appl. No.: 763,397

[22] Filed: Dec. 11, 1996

[51] Int. Cl.[6] ..... F02M 25/07

[52] U.S. Cl. ..... 123/570

[58] Field of Search ..... 123/570; 60/605.2

[56] References Cited

U.S. PATENT DOCUMENTS

| | | | |
|---|---|---|---|
| 1,833,611 | 11/1931 | Kirgan | 165/158 |
| 3,831,377 | 8/1974 | Morin | 60/274 |
| 4,011,845 | 3/1977 | Mayer et al. | 123/570 |
| 4,105,065 | 8/1978 | Chirico | 165/78 |
| 4,147,141 | 4/1979 | Nagano | 123/570 |
| 4,291,760 | 9/1981 | Argyle et al. | 123/570 |
| 4,323,045 | 4/1982 | Yamashita | 123/570 |
| 4,972,903 | 11/1990 | Kwok | 165/158 |
| 5,203,311 | 4/1993 | Hitomi et al. | 123/570 |
| 5,440,880 | 8/1995 | Ceynow et al. | 60/605.2 |
| 5,546,915 | 8/1996 | Isobe | 123/570 |
| 5,617,726 | 4/1997 | Sheridan et al. | 123/570 |

FOREIGN PATENT DOCUMENTS

| | | | |
|---|---|---|---|
| 176312 | 10/1982 | Japan | 123/570 |

*Primary Examiner*—Willis R. Wolfe

*Attorney, Agent, or Firm*—Woodard, Emhardt, Naughton, Moriarty & McNett

[57] ABSTRACT

A system for controlling the temperature of recirculated exhaust gas supplied to an internal combustion engine is provided. In one embodiment, the system includes a heat exchanger having the recirculated exhaust gas flowing therethrough and further having coolant fluid flowing therethrough. A control valve is disposed within the flow path of the coolant fluid, and the valve position is modulated to vary the rate of coolant fluid flow through the heat exchanger, thereby controlling the temperature of the recirculated exhaust gas supplied by the heat exchanger. In another embodiment, the heat exchanger defines a number of exhaust gas flow passages therethrough and a number of gas flow control valves are disposed between the exhaust gas inlet of the heat exchanger and the number of exhaust gas flow passages. The exhaust gas flow control valves are selectively actuated to disable exhaust gas flow through any number of subsets of the exhaust gas flow passages, thereby controlling the temperature of recirculated exhaust gas supplied by the heat exchanger.

58 Claims, 8 Drawing Sheets

SYSTEM FOR CONTROLLING RECIRCULATED EXHAUST GAS TEMPERATURE IN AN INTERNAL COMBUSTION ENGINE

FIELD OF THE INVENTION

The present invention relates generally to exhaust gas recirculation (EGR) systems of internal combustion engines, and more specifically to techniques for controlling recirculated gas temperature.

BACKGROUND OF THE INVENTION

It is generally recognized that the production of noxious oxides of nitrogen ($NO_x$) which pollute the atmosphere are undesirable. Steps are therefore typically taken to eliminate, or at least minimize, the formation of $NO_x$ constituents in the exhaust gas products of an internal combustion engine.

The presence of $NO_x$ in the exhaust gas of internal combustion engines is generally understood to depend, in large part, on the temperature of combustion within the combustion chamber of the engine. In connection with controlling the emissions of such unwanted exhaust gas constituents from internal combustion engines, it is widely known to recirculate a portion of the exhaust gas back to the air intake portion of the engine (so-called exhaust gas recirculation or EGR). Since the recirculated exhaust gas effectively reduces the oxygen concentration of the combustion air, the flame temperature at combustion is correspondingly reduced, and since $NO_X$ production rate is exponentially related to flame temperature, such exhaust gas recirculation (EGR) has the effect of reducing the emission of $NO_x$.

It is further known to cool the recirculated exhaust gas prior to introduction of the gas at the engine air intake port. An EGR cooler is therefore typically arranged within the exhaust gas recirculation system to cool the stream of recirculated exhaust gas. The temperature of the exhaust gas exiting from the cooler is critical both to the $NO_x$ control process and to the integrity of the cooler and the downstream components, such as EGR conduits, EGR flow control valves and the engine itself. However, due to the wide range of EGR gas conditions at the cooler, and under certain operating conditions of the engine, it is desirable to have active control of the EGR gas temperature at the outlet of the EGR cooler. For example, while a typical EGR cooler may satisfactorily cool EGR gas under full-load engine conditions, under light-loaded conditions of the engine, that is, where EGR flow rates are relatively low, the EGR gas may be over-cooled. This results in the accumulation of carbon and acid condensates on the mechanical components downstream of the EGR cooler outlet, thereby compromising the integrity of the EGR cooler and the downstream mechanical components, including the engine.

FIG. 1 is a diagrammatical illustration of a known EGR system 10 including known components for actively controlling the temperature of the recirculated exhaust gas. Referring to FIG. 1, an internal combustion engine 12 includes an air intake manifold 14 attached to the engine 12 and coupled to the various combustion chambers of the engine, which receives intake ambient air via conduit 16. An exhaust gas manifold 18 is attached to the engine 12 and coupled to the exhaust gas ports of the various combustion chambers of the engine, and supplies exhaust gas to the ambient via exhaust gas conduit 20. The engine 12 typically includes a fan 22 which is driven by the rotary motion of the engine, and which is typically used to cool engine coolant fluid flowing through a radiator (not shown) positioned proximate to the fan 22.

A first conduit 24 is connected at one end to the exhaust gas manifold 18, and at its opposite end to EGR cooler 26. An EGR flow control valve 28 is connected at one end thereof to EGR cooler 26 via conduit 30, and at an opposite end thereof to intake manifold 14 via conduit 32.

In accordance with one known technique for actively controlling the temperature of the recirculated exhaust gas provided to EGR flow control valve 28, and example of which is set forth in U.S. Pat. No. 4,147,141 to Nagano, a second exhaust gas flow control valve 40 is interposed between sections of conduit 24, and provides a bypass flow path therefrom to conduit 30 via conduit 42 (both shown in phantom). A control circuit 34 includes an input/output (I/O) port connected to EGR flow control valve 28 via signal path 38, and an output OUT1 connected to exhaust gas flow control valve 40 via signal path 44.

In operation, the EGR flow control valve 28 may include a temperature sensor therein which provides a temperature signal to control circuit 34, via signal path 38, corresponding to the temperature of recirculated exhaust gas provided to valve 28. In response to the temperature signal, control circuit 34 provides a corresponding control signal to exhaust gas control valve 40, which is operable to divert any desired amount of exhaust gas directly to EGR flow control valve 28 via conduit 40, thereby bypassing EGR cooler 26. In this manner, control system 34 is operable to control the temperature of recirculated exhaust gas supplied to EGR flow control valve 28 by controlling the amount of recirculated exhaust gas that flows through EGR cooler 26, and the amount of recirculated exhaust gas that flows through bypass conduit 42.

In accordance with another known technique for actively controlling the temperature of the recirculated exhaust gas provided to EGR flow control valve 28, an example of which is set forth in U.S. Pat. No. 4,323,045 to Yamashita, control circuit 34 includes an output OUT2 connected to a fan 46 via signal path 48 (shown in phantom). In the Yamashita system, exhaust gas flow control valve 40 and bypass conduit 42 are omitted so that conduit 24 connects exhaust gas manifold 18 directly to EGR cooler 26. In operation, control circuit 34 monitors intake manifold air pressure via signal path 38, which may be connected to a pressure sensor mechanism located within EGR flow control valve 28 or a separate pressure sensing mechanism coupled to the air intake manifold, and actuates the fan 46, which is located proximate to EGR cooler 26, accordingly. For example, when the engine load is low, and air intake vacuum is high, control system 34 does not actuate fan 26, and EGR cooler 26 is therefore not externally cooled. However, as engine load increases, and intake manifold vacuum correspondingly decreases, control system 34 energizes fan 46, which externally cools EGR cooler 26 and thereby enhances the cooling effect thereof.

While each of the foregoing known techniques for actively controlling the temperature of recirculated exhaust gas may be somewhat effective, both suffer from inherent drawbacks. For example, while the Nagano arrangement provides for a high degree of control over the temperature of recirculated exhaust gas provided to EGR flow control valve 28, it should be understood that, under certain engine operating conditions, the recirculated exhaust gas provided to EGR flow control valve 28 may be a mixture of un-cooled exhaust gas flowing through bypass conduit 42 and over-cooled exhaust gas flowing through EGR cooler 26 and the portion of conduit 30 upstream of bypass conduit 42. Under such operating conditions, EGR cooler 26 and the portion of conduit 30 upstream of bypass conduit 42 are thus subject to the deleterious effects of over-cooled exhaust gas as described above. Moreover, available space in the engine compartment of the vehicle may be limited, and there simply may not be room to include the extra bypass conduit 42 and associated exhaust gas flow control valve 40. While fan 46, on the other hand, provides for enhanced cooling of the EGR cooler 26 itself, and may thereby obviate the need for bypass conduit 42, the fan arrangement provides for only a relatively low degree of recirculated exhaust gas temperature control. Specifically, fan 46 permits only a two-level cooling effect, i.e. either fan "off" or fan "on".

What is therefore needed is a system for providing active control over recirculated exhaust gas temperature that permits a high-degree of temperature control while minimizing exhaust gas over-cooling conditions which lead to degradation in the integrity of the EGR cooler and the downstream mechanical components, including the engine. Preferably, such an EGR temperature control system should consume minimal space in the engine compartment, and should therefore preferably be incorporated within the EGR cooler design itself.

SUMMARY OF THE INVENTION

The foregoing shortcomings of known prior art systems are addressed by the present invention. In accordance with one aspect of the present invention, an apparatus for controlling the temperature of recirculated exhaust gas in an internal combustion engine comprises a first conduit coupled at one end to an exhaust gas port of the engine, a second conduit coupled at one end to an air inlet port of the engine, and a heat exchanger including a gas inlet port connected to an opposite end of the first conduit and receiving exhaust gas therefrom, and a gas outlet port connected to an opposite end of the second conduit and supplying recirculated exhaust gas thereto. The heat exchanger further includes means for varying a heat exchange capability of the heat exchanger, and the apparatus further includes means for controlling the means for varying a heat exchange capability of the heat exchanger, to thereby control the temperature of the recirculated exhaust gas.

In accordance with another aspect of the present invention, the apparatus further includes a source of coolant fluid, the heat exchanger includes a coolant inlet port connected to the source of coolant fluid and a coolant outlet port, and defines a coolant flow path therethrough from the source of coolant fluid to the coolant outlet port. The means for varying a heat exchange capability of the heat exchanger includes a coolant control valve disposed within the coolant flow path, which is operable to control a rate of coolant flow therethrough. One means for controlling the means for varying a heat exchange capability of the heat exchanger includes means for determining recirculated exhaust gas temperature and modulating the coolant control valve in accordance therewith to thereby control the temperature of the recirculated exhaust gas. Alternatively, the means for controlling the means for varying heat exchange capability of the heat exchanger includes means for determining a flow rate of the recirculated exhaust gas and modulating the coolant control valve in accordance therewith to thereby control the temperature of the recirculated exhaust gas.

In accordance with a further aspect of the present invention, the heat exchanger defines a number of exhaust gas flow paths therethrough from the gas inlet port to the gas outlet port, and wherein the means for varying a heat exchange capability of the heat exchanger includes means for selectively disabling exhaust gas flow through certain ones of the number of exhaust gas flow paths. One means for controlling the means for varying heat exchange capability of the heat exchanger includes means for determining recirculated exhaust gas temperature and selectively disabling exhaust gas flow through certain ones of the number of exhaust gas flow paths in accordance therewith to thereby control the temperature of the recirculated exhaust gas. Alternatively, the means for controlling the means for varying heat exchange capability of the heat exchanger includes means for determining a flow rate of the recirculated exhaust gas and selectively disabling exhaust gas flow through certain ones of the number of exhaust gas flow paths in accordance therewith to thereby control the temperature of the recirculated exhaust gas.

In accordance with yet another aspect of the present invention, the heat exchanger defines a gas bypass channel therethrough from the gas inlet port to the gas outlet port, wherein the gas bypass channel bypasses all gas flow paths therethrough such that the temperature of exhaust gas flowing through the heat exchanger is only minimally affected by the heat exchanger.

One object of the present invention is to provide a system for actively controlling the temperature of recirculated exhaust gas provided to an internal combustion engine.

Another object of the present invention is to provide such a system having an EGR cooler coupled to a source of coolant fluid, wherein a control system is operable to modulate the rate of coolant fluid flow therethrough to thereby control the temperature of recirculated exhaust gas.

Yet another object of the present invention is to provide such a system having an EGR cooler defining a number of EGR gas flow paths therethrough, wherein the EGR cooler includes means for selectively disabling EGR gas through certain ones of the number of EGR gas flow paths to thereby control the temperature of the recirculated exhaust gas.

These and other objects of the present invention will become more apparent from the following description of the preferred embodiment.

DESCRIPTION OF THE PREFERRED EMBODIMENT

Figure 1:
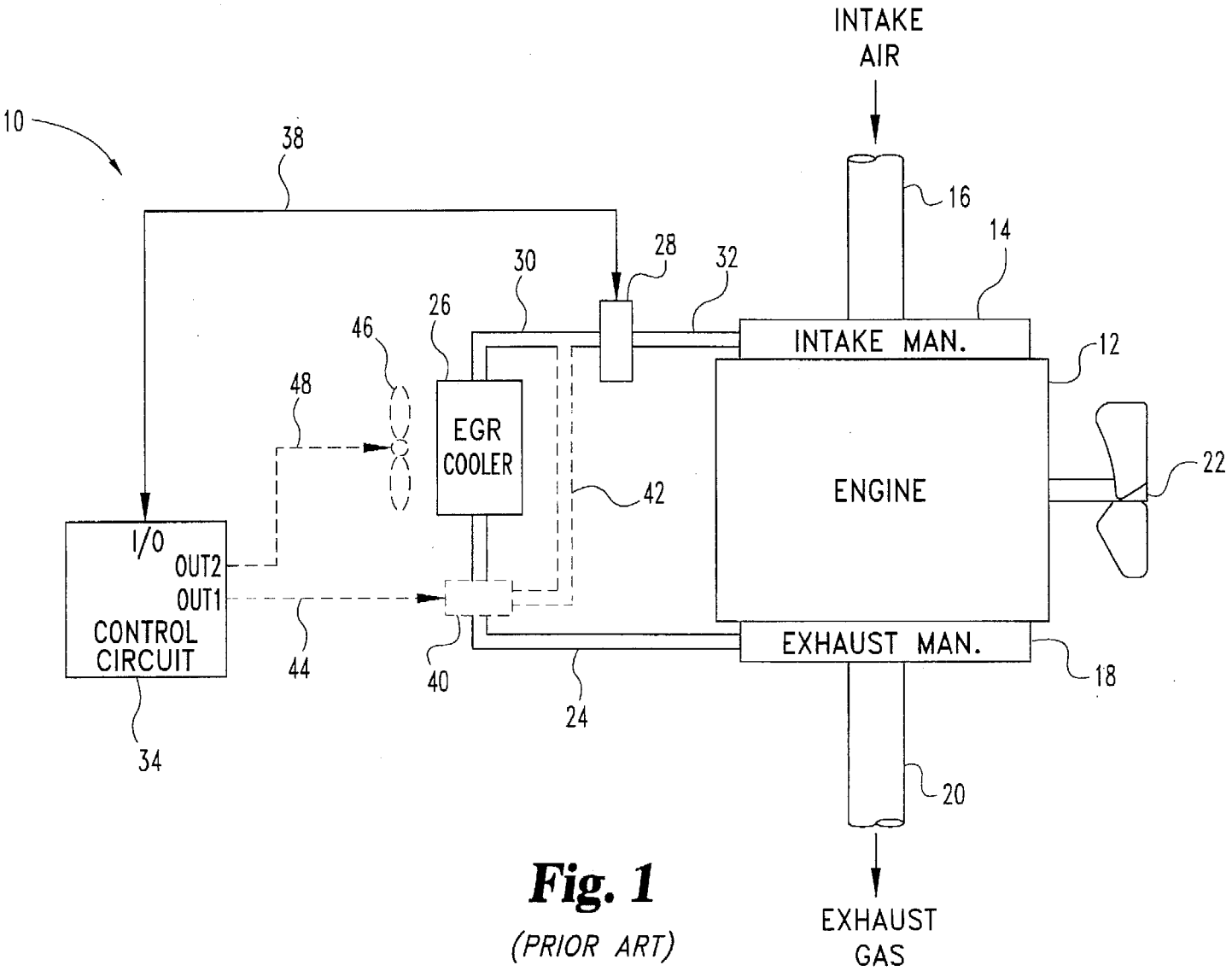
Fig. 1 (PRIOR ART)
FIG. 1 is a diagrammatic illustration of known techniques for actively controlling the temperature of recirculated exhaust gas provided to an air intake port of an internal combustion engine.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention is directed to techniques for controlling recirculated exhaust gas temperature in an exhaust gas recirculation system of an internal combustion engine. In so doing, the present invention exercises active control over the recirculated exhaust gas temperature by controlling the heat exchange capability of a heat exchanger, or EGR cooler, in an exhaust gas recirculation system. As used herein, the term "heat exchange capability" of such a heat exchanger is defined as the ability of the heat exchanger itself to transfer heat therefrom to ambient. In accordance with the present invention, two techniques (or a combination thereof) are disclosed for controlling the heat exchange capability of an EGR heat exchanger.

The EGR gas temperature exiting from an EGR heat exchanger depends of many factors including EGR mass flow rate and effective Reynolds number (heat exchanger effectiveness), heat exchanger coolant flow rate (in fluid cooled heat exchangers), the state of EGR gas at the heat exchanger inlet (pressure, temperature and composition vary with such factors as engine speed and load, air-fuel ratio, fuel composition and the like), coolant temperature at the heat exchanger cooler inlet (which varies as a function of engine speed and load, ambient temperature and other factors), the extent of fouling or exhaust deposits in the heat exchanger and the design of the heat exchanger itself (including cooling mechanism such as air or liquid, flow type such as parallel-flow or counter-flow, active heat exchanging surface, and other factors).

In accordance with the present invention, the heat exchange capability of an EGR heat exchanger is controlled by varying either the heat exchanger effectiveness or the heat exchanger coolant flow rate (or a combination of the two), both of which have the ultimate effect of controlling the temperature of EGR gas exiting the heat exchanger.

Figure 2:
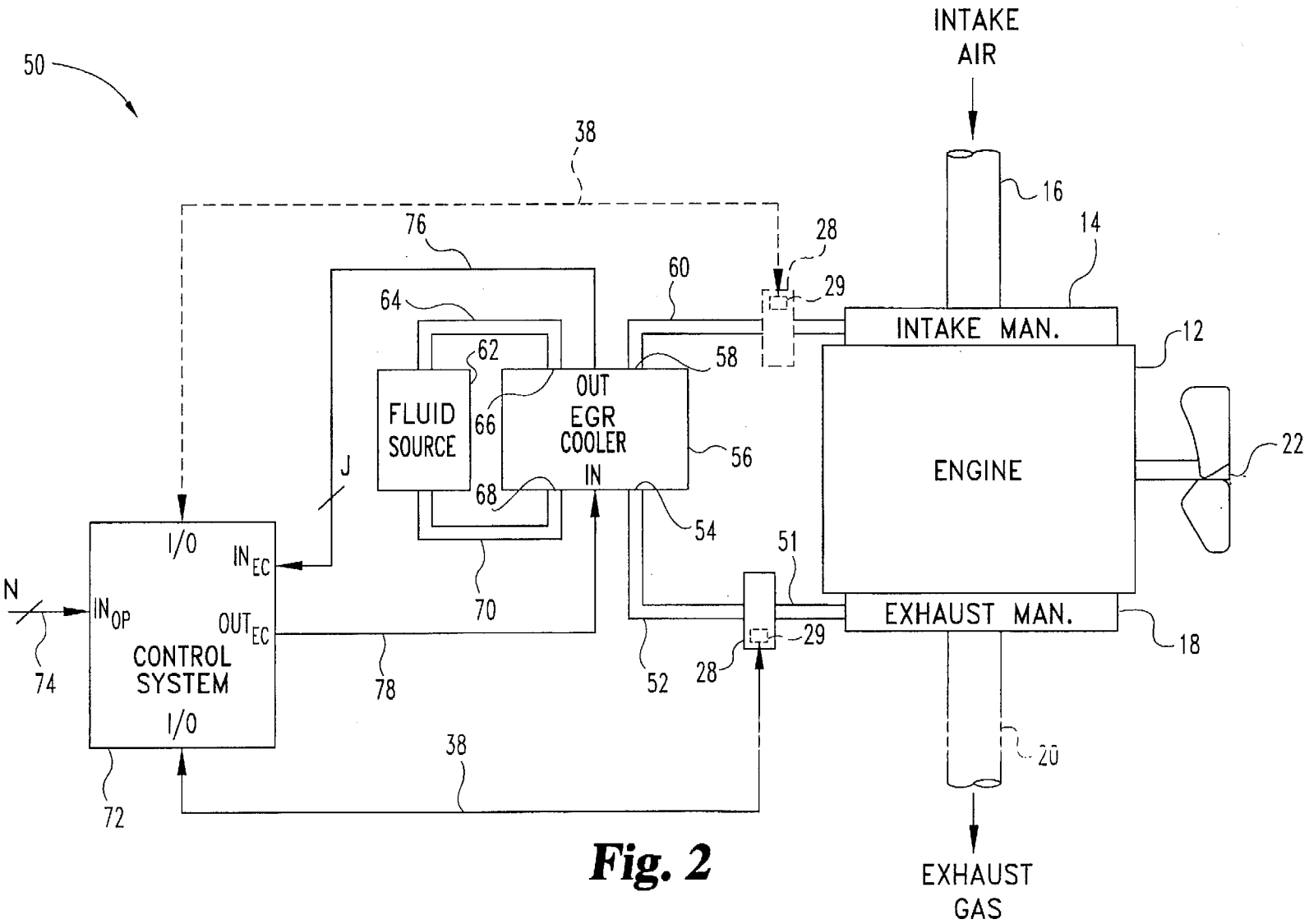
FIG. 2 is a diagrammatic illustration of one embodiment of a system for actively controlling recirculated exhaust gas temperature provided to an air intake port of the engine, in accordance with one aspect of the present invention.

Referring now to FIG. 2, one embodiment of a system 50 for actively controlling recirculated exhaust gas temperature, in accordance with one aspect of the present invention, is shown. System 50 includes an internal combustion engine 12 having an air intake manifold 14 attached thereto and coupled to the various combustion chambers of the engine (not shown), which receives intake ambient air via conduit 16. An exhaust manifold 18 is attached to the engine 12 and coupled to the exhaust ports of the various combustion chambers of the engine (not shown), and supplies exhaust gas to the ambient via exhaust gas conduit 20. The engine 12 includes a fan 22 which is driven by the rotary motion of the engine, and which may be used to cool fluid source 62 as will be described hereinafter. In one preferred embodiment, internal combustion engine 12 is a diesel engine, although the present invention contemplates utilizing the techniques described herein with any internal combustion engine.

A first conduit 51 is connected at one end to the exhaust gas manifold 18, and at its opposite end to a known EGR flow control valve 28. A second conduit 52 is connected at one end to EGR flow control valve 28, and at its opposite end to an input port 54 of a heat exchanger, or EGR cooler 56. An output port 58 of EGR cooler 56 is connected to air intake manifold 14 via conduit 60. Alternatively, as shown in phantom in FIG. 2, EGR flow control valve may be interposed between EGR cooler 56 and air intake manifold 14, and connected to conduit 60 as shown.

A source of heat exchanger coolant fluid 62 is connected via conduit 64 to a coolant inlet port 66 of EGR cooler 56, and a coolant outlet port 68 of EGR cooler 56 is connected back to coolant fluid source 62 via conduit 70. Preferably, coolant fluid source 62 is a known engine radiator positioned proximate to cooling fan 22, and contains a known engine coolant fluid flowing therethrough, although the present invention contemplates that coolant fluid source 62 may be any source of coolant fluid. For example, the present invention contemplates utilizing a coolant fluid source having a coolant fluid therein with a boiling point that is higher than conventional water-glycol engine coolant fluid. In such a case, coolant fluid source 62 and conduits 64 and 70 would require at least a fluid pump, condenser and fluid pressure control device (not shown) as is known in the art. Such a coolant fluid could be circulated through EGR cooler 56 at a temperature which would be a function of the coolant fluid pressure, thereby providing for highly accurate control of EGR gas temperature, and permitting resultantly higher EGR gas temperatures than with conventional water-glycol mixtures.

An electronic control system 72 is operable to receive a number N of inputs indicative of various vehicle, system or machine operating parameters at input $IN_{OP}$ via signal path 74. An input/output (I/O) is connected to EGR flow control valve 28 via signal path 38, whereby control system 72 is operable to control the flow rate of recirculated exhaust gas therethrough in accordance with known techniques. Input $IN_{EC}$ of control system 72 is connected to an output OUT of EGR cooler 56 via signal path 76, which may include any number J of signal lines. An output $OUT_{EC}$ of control system 72 is connected to a signal input IN of EGR cooler 56 via signal path 78. Preferably, control system 72 is microprocessor-based and may comprise at least a portion of a known engine, vehicle or system control computer.

Figure 3:
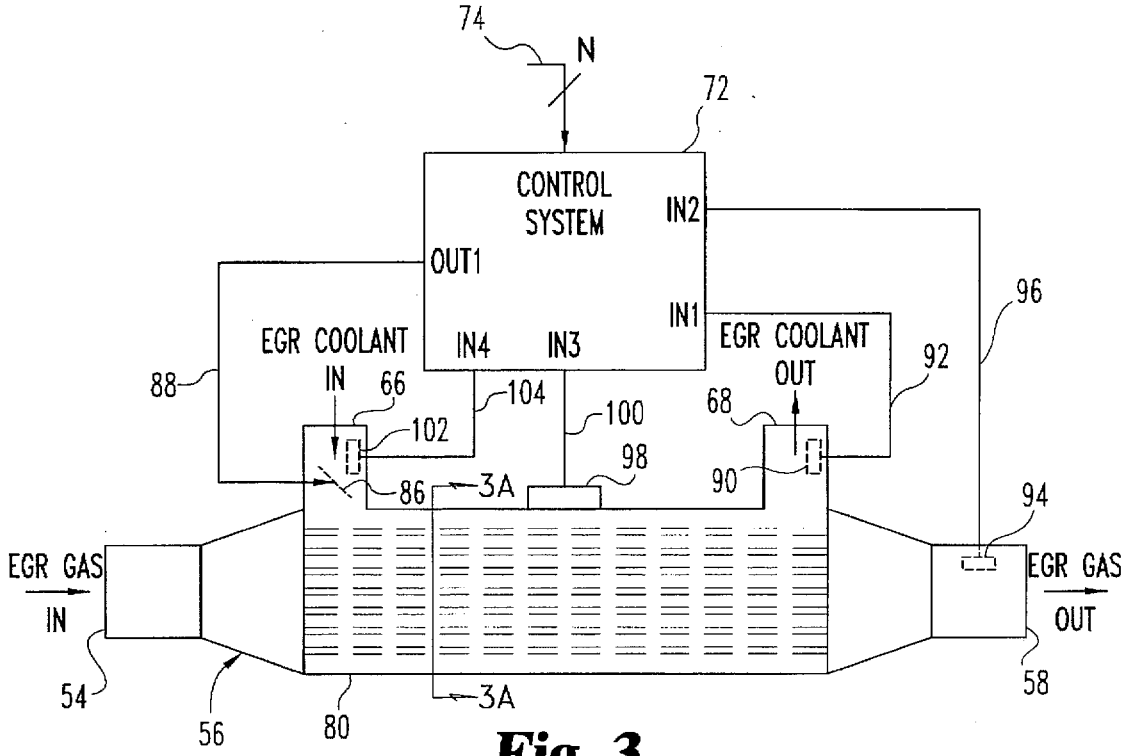
FIG. 3 is a diagrammatic illustration of the EGR cooler and associated control system components of FIG. 2, showing details thereof.
Figure 3A:
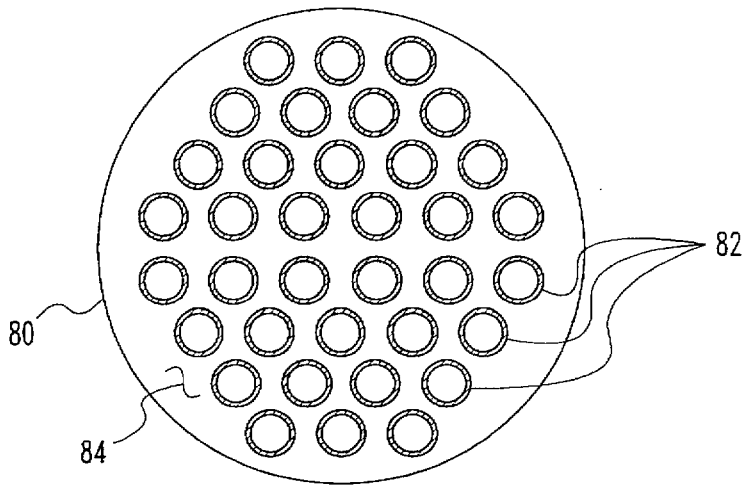
FIG. 3A is a cross-sectional view of the EGR cooler of FIG. 3, viewed along section lines 3A—3A.

Referring now to FIG. 3, a preferred embodiment of EGR cooler 56 and associated control system components are shown. EGR cooler 56 includes a housing 80 defining exhaust gas inlet port 54, EGR gas outlet 58, EGR coolant inlet 66 and EGR coolant outlet 68. Referring to FIG. 3A, exhaust gas entering EGR gas inlet 54 flows toward EGR gas outlet 58 via a number of exhaust gas flow paths 82, which are preferably constructed of hollow tubes. Areas 84 surrounding tubes 82 define a coolant flow path for the EGR coolant supplied by coolant fluid source 62. The EGR gas flow path structure of FIG. 3A is a known design for maximizing the surface area of EGR cooler 56 that may be cooled by EGR coolant fluid from coolant fluid source 62, wherein the surface area of EGR cooler 56 that is exposed to incoming exhaust gas is defined by the number and surface area of exhaust gas flow paths 82.

In accordance with an important aspect of the present invention, control system 72 is, in the embodiment shown in FIG. 3, operable to determine recirculated exhaust gas temperature and modulate the rate of EGR coolant fluid flow through EGR cooler 56. To this end, EGR cooler 56 may include one or more temperature sensors operable to sense the temperature of a corresponding component of EGR cooler 56. For example, one temperature sensor 90 may be disposed within EGR cooler outlet port 68, which is connected to input IN1 of control system 72 via signal path 92. However, the present invention contemplates positioning temperature sensor 90 anywhere within EGR coolant outlet port 68 or conduit 70 (FIG. 2), the importance being that temperature sensor 90 is operable to sense the temperature of EGR coolant fluid exiting EGR cooler 56. A temperature sensor 94 may further be disposed within EGR gas outlet port 58 of EGR cooler 56, which is connected to input IN2 of control system 72 via signal path 96. As with temperature sensor 90, it is to be understood that temperature sensor 94 may be located anywhere within EGR gas outlet port 58, conduit 60 (FIG. 2), flow control valve 28 or conduit 32, the importance being in that temperature sensor 94 is operable to sense the temperature of EGR gas provided by EGR cooler 56 to the air intake manifold 14 of engine 12.

A temperature sensor 98 may further be attached to the housing 80 of EGR cooler 56, which is connected to input IN3 of control system 72 via signal path 100. Temperature sensor 98 may be attached anywhere on EGR cooler 56 in contact with housing 80, or in close proximity thereto, the importance being that temperature sensor 98 is operable to sense a temperature of the housing 80 of EGR cooler 56. A temperature sensor 102 may further be disposed within EGR coolant inlet port 66, which is connected to input IN4 of control system 72 via signal path 104. Temperature sensor 102 may be positioned anywhere within EGR coolant inlet port 66 or conduit 64 (FIG. 2), the importance being that temperature sensor 102 is operable to sense the temperature of EGR coolant fluid flowing from coolant fluid source 62 into EGR cooler 56.

Also disposed within EGR coolant inlet port 66 is an EGR coolant fluid flow control valve 86, which is connected to output OUT1 of control system 72 via signal path 88. Preferably, EGR coolant fluid flow control valve 86 is a known butterfly-type valve that may be electronically actuatable via control system 72, although the present invention contemplates utilizing any known valve and/or mechanical linkage system attached thereto which can be electronically controlled by control system 72. In any case, the position of valve 86 within EGR coolant inlet port 66 is preferably continuously variable to thereby allow control system 72 to accurately modulate the rate of flow of EGR coolant fluid through EGR cooler 56. Further, while valve 86 is shown in FIG. 3 as positioned within EGR cooler inlet port 66, it is to be understood that valve 86 may be positioned anywhere within EGR coolant inlet port 66, conduits 64 or 70 (FIG. 2), EGR coolant outlet port 68 or within the fluid source 62 or EGR cooler 56, the importance of such positioning being only that valve 86 is operable to modulate the rate of flow of EGR coolant fluid through EGR cooler 56.

In operation, the rate of EGR coolant fluid flow through EGR cooler 56 is controlled by control system 72 to provide the required EGR gas temperature supplied at EGR gas outlet port 58. For constant EGR gas flow conditions, the temperature of the EGR coolant fluid exiting EGR coolant outlet port 68 will increase as the EGR coolant fluid inlet flow rate at EGR coolant inlet port 66 is reduced via actuation of valve 86, thereby resulting in increased EGR gas temperature at EGR gas outlet port 58. Conversely, increasing the EGR coolant flow rate through EGR coolant inlet port 66 via actuation of valve 86 causes the temperature of the EGR coolant fluid exiting EGR cooler outlet port 68 to decrease, resulting in a decrease in the EGR gas temperature at EGR gas outlet port 58.

Figure 4:
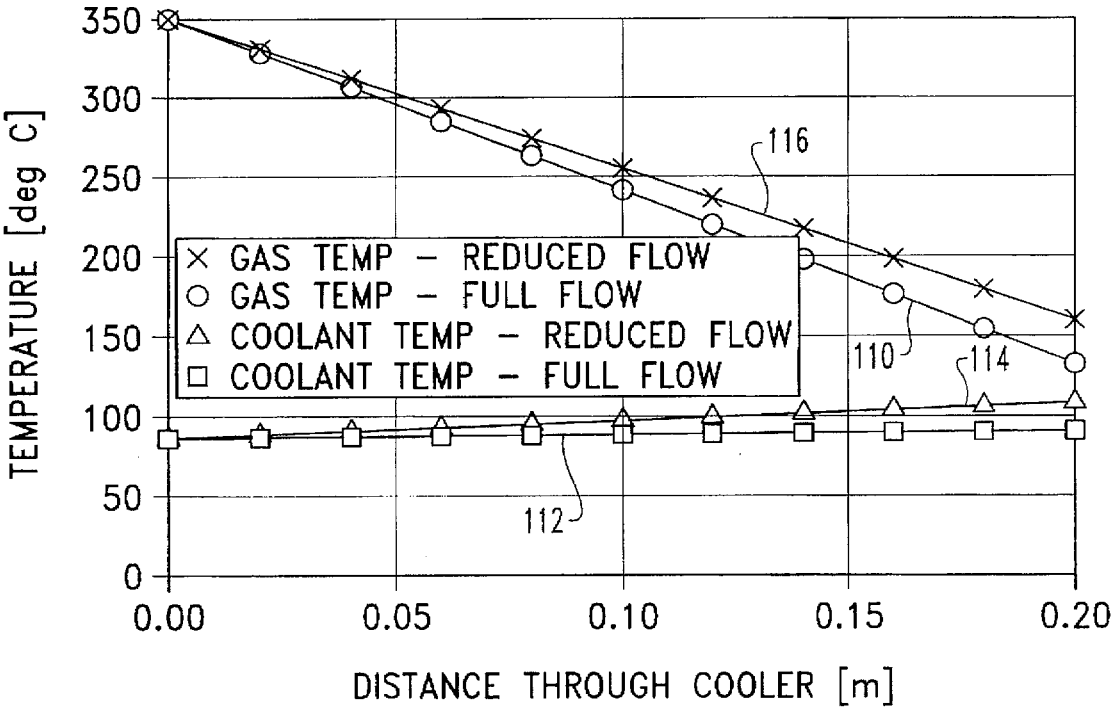
FIG. 4 is a chart illustrating the effect on EGR temperature and EGR coolant temperature of the EGR temperature control system of FIG. 2.

The foregoing concepts are illustrated in the chart of FIG. 4, which illustrates the effect on EGR coolant fluid outlet temperature and EGR gas outlet temperature of a modulation in the flow rate of EGR coolant fluid through EGR cooler 56. While the chart of FIG. 4, as well as EGR cooler 56 illustrated in FIGS. 3 and 3A, describe a so-called parallel-flow EGR cooler, it is to be understood that EGR coolers having other flow-types may also be used with the present invention, including, for example, counter-flow EGR coolers. Referring to FIG. 4, EGR gas temperature signal 110 illustrates the effect on EGR gas temperature of EGR cooler 56 as the exhaust gas flows through EGR cooler 56 under maximum EGR coolant fluid flow conditions. Similarly, EGR coolant fluid temperature signal 112 illustrates the temperature of EGR coolant fluid as it flows through EGR cooler 56. It should be noted that under full EGR coolant fluid flow conditions, the temperature of EGR coolant fluid 112 remains relatively constant, while the temperature of EGR gas 110 decreases from approximately 350° C. at EGR gas inlet port 54 to approximately 135° C.

EGR gas temperature signal 116 illustrates the effect on EGR gas temperature of EGR cooler 56 under reduced EGR coolant fluid flow conditions. Similarly, EGR coolant fluid temperature signal 114 illustrates the temperature of EGR coolant fluid as it flows through EGR cooler 56 under such reduced flow conditions. Under reduced flow conditions, which control system 72 controls via actuation of valve 86, the EGR coolant fluid 114 rises from approximately 90° C. at the EGR coolant fluid inlet port 66 to approximately 110° C. at the EGR coolant fluid outlet port 68. This, in turn, reduces the heat exchange capability of EGR cooler 56 such that the EGR gas temperature is cooled from approximately 350° C. at EGR gas inlet port 54 to only approximately 160° C. at EGR gas outlet port 58. Such active control over EGR gas outlet temperature under light engine load and/or idle conditions of an internal combustion engine significantly reduces the tendency to foul EGR cooler 56 and produce corrosive condensates thereon and on mechanical components downstream of EGR cooler 56.

In accordance with another aspect of the present invention, EGR coolant flow control valve 86 may be controlled via control system 72 according to an EGR flow rate signal. In one preferred embodiment, system 50 is incorporated into an automotive application having a known electronic control system. Such an electronic control system typically includes a number of known sensors for determining such engine operating parameters as engine load, engine speed, mass air flow, intake manifold air pressure, percent throttle, and the like. Although not shown specifically in the drawings, outputs from such sensors, or outputs from such an electronic control system, may be received as one or more of the N inputs 74 at input $IN_{OP}$ of control system 72 (FIG. 2). Based on this information, EGR flow rate will be generally known, or readily computable from existing signals, in such systems so that an optimum, or desired, EGR gas temperature can be determined as a function thereof, or as a function of any number or combination of such engine operating parameters.

As shown in FIG. 2, EGR flow control valve 28 may additionally or alternatively include a pressure sensing mechanism 29 which is operable to sense the pressure of EGR gas flowing through valve 28 and provide a signal corresponding thereto to control system 72. Pressure sensing mechanism 29 may be actually positioned anywhere within the EGR gas flow path, the importance being that mechanism 29 is operable to sense the pressure of EGR gas provided by EGR cooler 56 to intake manifold 14 of engine 12. Control system 72 is operable to convert such a pressure signal to a flow rate signal in accordance with known techniques. Control system 72 is then responsive to the EGR gas flow rate signal provided thereto at I/O to control the position of valve 86. For example, when engine load is high, the flow rate of EGR gas provided by EGR cooler 56 is correspondingly high so that control system 72 positions valve 86 to provide a correspondingly high flow rate of coolant fluid through EGR cooler 56, thereby lowering the temperature of EGR gas provided by cooler 56. Conversely, under light engine load conditions, the flow rate of EGR gas provided by EGR cooler 56 is correspondingly low so that control system 72 positions valve 86 so as to restrict the flow rate of coolant fluid through EGR cooler 56, thereby increasing the temperature of EGR gas provided by EGR cooler 56.

In accordance with the present invention, control system 72 is thus operable to control the position of EGR coolant fluid flow control valve 86 in accordance with one or more engine/machine parameters provided thereto. For example, the demand for EGR cooling can be calculated in accordance with the demand for EGR flow rate provided by EGR flow control valve 28 such that any additional heat load may be anticipated and coolant flow adjusted accordingly via EGR coolant flow control valve 86. Alternatively or additionally, closed-loop control of EGR coolant fluid flow may be achieved by determining the temperature of EGR gas supplied at EGR gas outlet 58 and adjusting the position of EGR coolant flow control valve 86 accordingly. It is to be understood, however, that while existing engine operating parameters and/or a pressure sensing mechanism 29 may be used to determine an optimum EGR gas temperature or EGR flow rate, other known mechanisms and/or techniques may be substituted therefore to provide control system 72 with a signal or signals indicative of an optimum EGR gas temperature and/or EGR flow rate control system.

In one embodiment of such a closed-loop temperature, control system 72 is operable to sense the temperature of EGR gas flowing from EGR gas outlet port 58 via temperature sensor 94, and modulate EGR coolant flow control valve 86 in accordance therewith to achieve a desired EGR gas outlet temperature. Alternatively, control system 72 may be operable to sense the temperature of the housing 80 of EGR cooler 56 and modulate the position of EGR coolant fluid flow control valve 86 in accordance therewith to achieve a desired EGR gas outlet temperature at EGR gas outlet port 58. In another alternative embodiment, control system 72 is operable to sense EGR coolant outlet temperature via temperature sensor 90, and EGR coolant inlet temperature via temperature sensor 102, and modulate the position of EGR coolant fluid flow control valve 86 in accordance therewith to achieve a desired EGR gas temperature at EGR gas outlet port 58. When basing the position of EGR coolant flow control valve 86 on either the temperature sensor signal from temperature sensor 98 or the temperature sensor signals from temperature sensors 90 and 102, control system 72 is preferably operable to map the temperature signals provided thereby to a known or estimated EGR gas temperature exiting EGR gas outlet port 58. For example, it is known that the temperature of housing 80 of EGR cooler 56 is directly proportional to the temperature of EGR gas supplied by EGR gas outlet 58. Alternatively, EGR gas outlet temperature can be estimated from the difference in temperature in EGR coolant fluid flowing into and out of EGR cooler 56 via temperature sensors 90 and 102. It is to be understood, however, that the present invention further contemplates actuating EGR coolant fluid control valve 86 strictly in accordance with the temperature signals provided by any of temperature sensors 90, 98 and/or 102 without mapping such signals to a known or estimated EGR gas outlet temperature.

Figure 5:
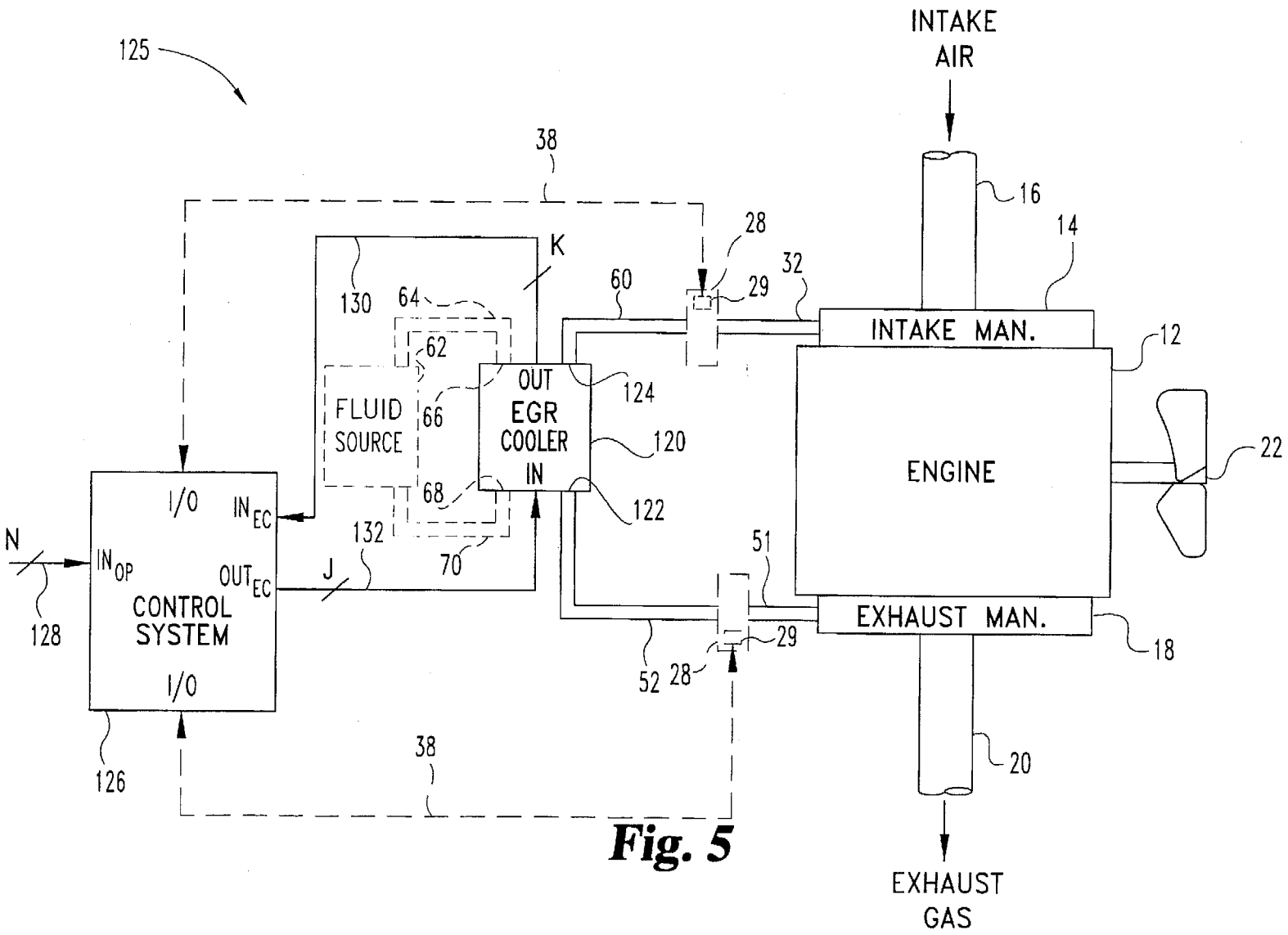
FIG. 5 is a diagrammatic illustration of another embodiment of a system for controlling the temperature of recirculated exhaust gas provided to an air intake port of the engine, in accordance with another aspect of the present invention.

Referring now to FIG. 5, another embodiment of a system 125 for controlling the temperature of recirculated exhaust gas provided to an air intake port of the engine, in accordance with another aspect of the present invention, is shown. System 125 is identical in many respects to system 50 shown in FIG. 2, and like reference numbers will be used to identify like components. System 125 includes an engine 12, intake manifold 14, air intake port 16, exhaust manifold 18, exhaust gas port 20, fan 22 and conduits 51, 52 and 60 interconnected as described with respect to FIG. 2.

System 125 further includes an EGR cooler 120 having an EGR gas inlet port 122 connected to conduit 52 and an EGR gas outlet port 124 connected to conduit 60. EGR cooler 120 may or may not include fluid source 62 and associated structure as shown in phantom in FIG. 5, which components have been fully described hereinabove.

A control system 126, identical in many respects to control system 72 of FIG. 2, includes an input $IN_{OP}$ which receives a number N of inputs corresponding to machine and/or engine operating parameters via signal path 128. Another input $IN_{EC}$ receives a number K of signals from a corresponding number of outputs OUT of EGR cooler 120 via signal path 130. Similarly, an output $OUT_{EC}$ of control system 126 provides a number J of control signal paths to a corresponding number of control signal inputs at input IN of EGR cooler 120 via signal path 132 as is known in the art. EGR fluid control valve 28 and signal path 38 may be optional in system 125, as will be discussed in greater detail hereinafter, and are therefore shown in phantom in two alternative locations as discussed with respect to FIG. 2.

Figure 6:
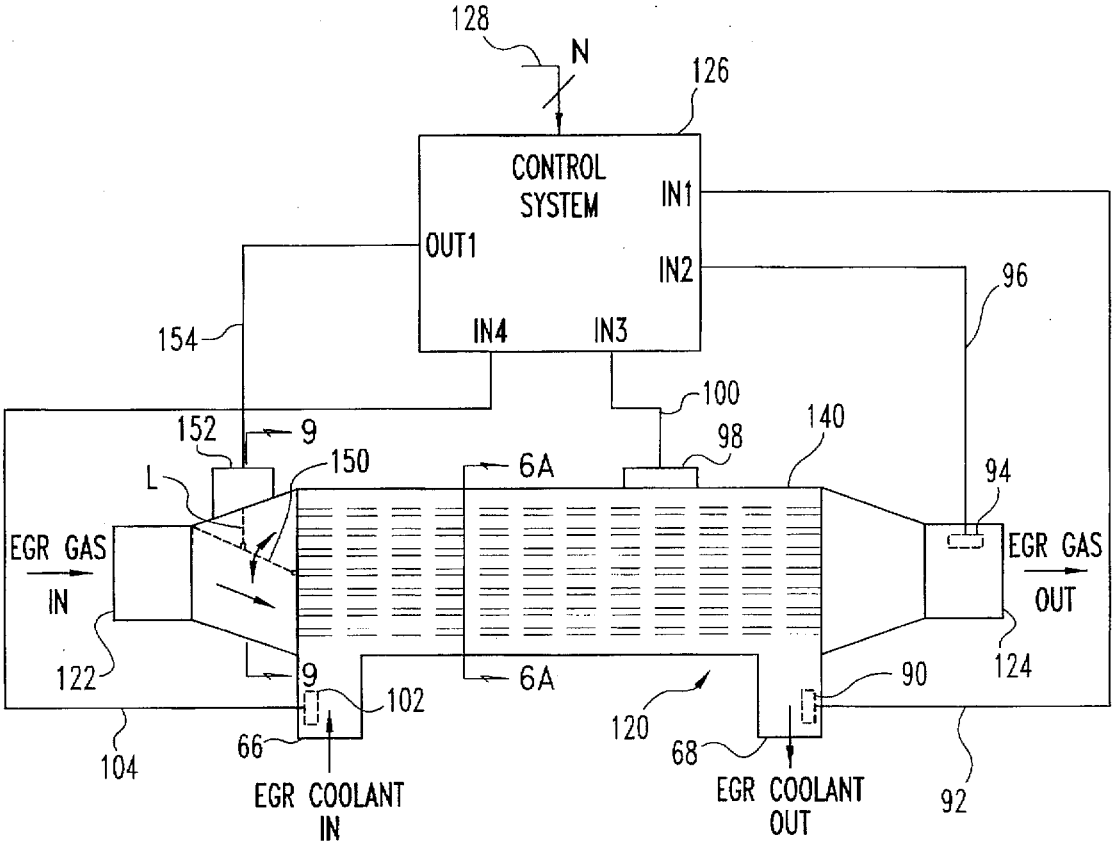
FIG. 6 is a diagrammatic illustration of one embodiment of the EGR cooler and associated control system components of FIG. 5, showing details thereof.

Referring now to FIG. 6, one embodiment of heat exchanger, or EGR cooler, 120 and associated control system components, in accordance with another aspect of the present invention, are shown. EGR cooler 120 includes an EGR gas inlet port 122 at one end thereof and an EGR gas outlet port 124 at an opposite end thereof. EGR cooler 120 includes a housing 140 defining EGR gas inlet port 122 and EGR gas outlet port 124, and in a preferred embodiment of EGR cooler 120, further defines EGR coolant inlet port 66 and EGR coolant outlet port 68. It is to be understood that provisions for EGR coolant fluid flow through EGR cooler 120 are not strictly required in system 125 of the present invention, although such coolant fluid flow is preferred.

Figure 6A:
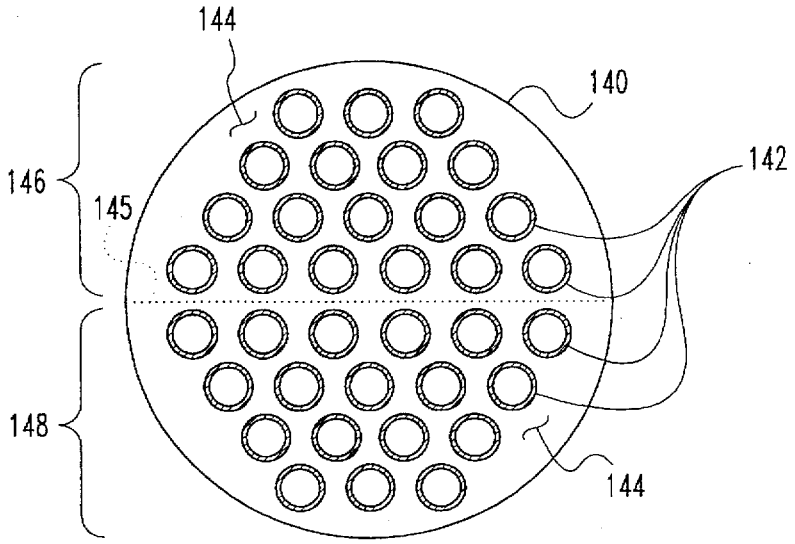
FIG. 6A is a cross-sectional view of tile EGR cooler of FIG. 6, viewed along section lines 6A—6A.

Between EGR gas inlet port 122 and EGR gas outlet port 124, EGR cooler 120 defines a number of EGR gas flow passages 142 therethrough, identical to exhaust gas flow paths 82 of FIG. 3A, as shown in FIG. 6A. Areas 144 about EGR gas flow passages 142 define an EGR coolant fluid flow path through EGR cooler 120.

Control system 126 may include one or more inputs correspondingly connected to one or more temperature sensors 90, 94, 98 and 102, identically as described with respect to FIG. 3. Such temperature sensors and their corresponding signal paths are therefore numbered identically to those in FIG. 3, and the description thereof will not be repeated here. Thus far, EGR cooler 120 is identical to EGR cooler 56 described with respect to FIG. 3.

Unlike EGR cooler 56 of FIG. 3, the EGR gas flow passages 142 of EGR cooler 120 are partitioned into two subsets 146 and 148 as shown in FIG. 6A. It is to be understood however, that the dashed dividing line 145 is included only to illustrate the partitioning of gas flow passages 142 into subsets 146 and 148, and should not be interpreted as defining a structural partition wall extending through cooler 120. A partitioning mechanism 150 separates the number of EGR gas flow passages 142 into the two subsets, and the partitioning mechanism 150 is preferably a flap valve or similar such structure coupled to an electronic actuator 152 via mechanical linkage L. Actuator 152 is connected to an output OUT1 of control system 126 via signal path 154. Flap valve 150 is actuatable by control system 126 to one of two positions. In a valve closed position, as illustrated in FIG. 6, flap valve 150 disables EGR gas entering EGR gas inlet 122 from flowing through gas flow passages 142 of subset 146. Conversely, in the valve opened position, EGR gas flowing into EGR gas inlet 122 is directed through all EGR gas passages 142 of subsets 146 and 148. Thus, control system 126 is operable to actuate flap valve 150 to either enable EGR gas flowing into EGR inlet 122 to flow through all EGR gas flow passages 142, or to disable EGR gas from flowing through EGR gas flow passages 142 of subset 146 and thereby enable flow only through those EGR gas passages 142 of subset 148. Preferably, subsets 146 and 148 include an equal number of EGR gas flow passages 142, as illustrated in FIG. 6A, although the present invention contemplates that EGR gas flow passages 142 may be partitioned into subsets 146 and 148 having unequal numbers of EGR gas flow passages 142 therein.

In the operation of the embodiment of system 125 illustrated in FIGS. 6 and 6A, the heat exchange capability of EGR cooler 120 is varied by changing the surface area of EGR cooler 120 exposed to incoming EGR gas by controlling the position of flap valve 150. As discussed here-inabove, the surface area of EGR cooler 120 that is exposed to incoming EGR gas is defined by the number and cross-sectional area of EGR gas flow passages 142.

The present invention contemplates actuating flap valve 150 via control system 126 in accordance with either temperature signals received from one or more temperature sensors 90, 94, 98 and 102, in a manner identical to that discussed hereinabove with respect to FIG. 3, or in accordance with either known engine operating parameters and/or an EGR flow rate signal provided by EGR flow rate control valve 28 as discussed hereinabove.

In any case, control system 126 is responsive to the temperature, EGR gas flow rate and/or other engine operating parameter signals provided thereto to control the position of flap valve 150. In accordance with any of the signals discussed hereinabove, flap valve 150 may be opened to allow passage of EGR gas through both subsets 146 and 148 of EGR flow passages 142, thereby maximizing the cooling effect of EGR cooler 120, or flap valve 150 may be closed so that incoming EGR gas is directed only through subset 148 of EGR flow passages 142, thereby decreasing the cooling effect of EGR cooler 120.

Figure 7:
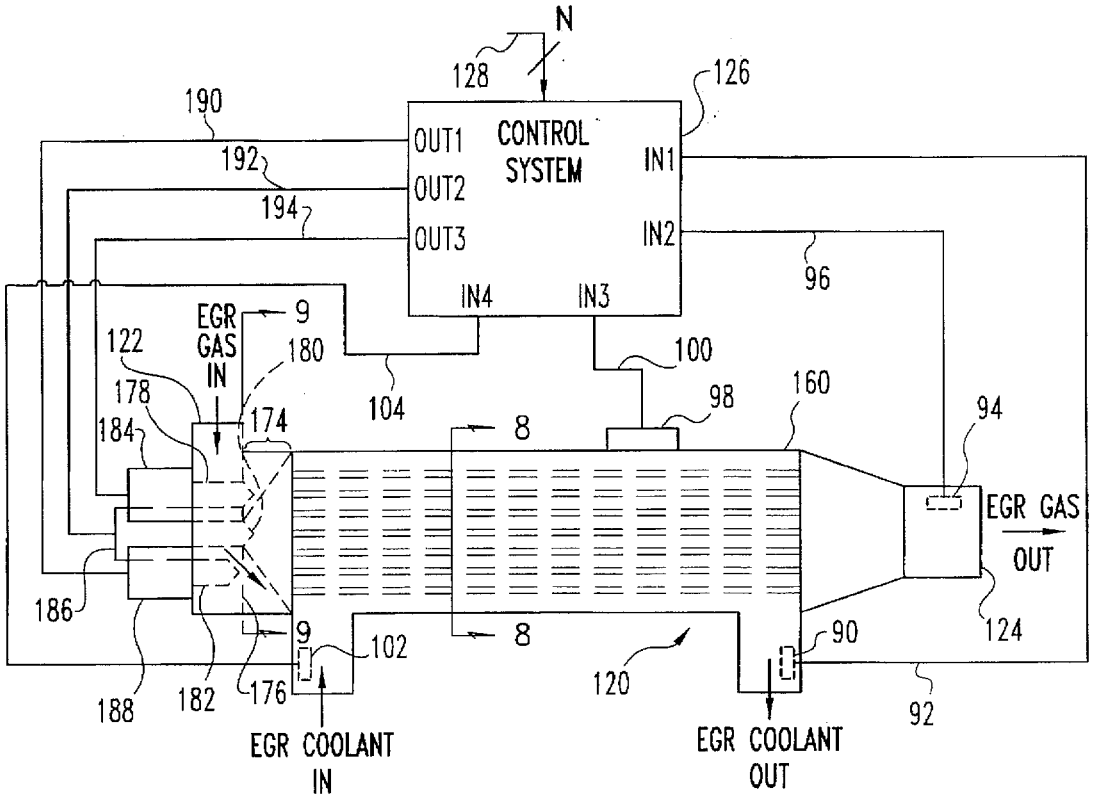
FIG. 7 is a diagrammatic illustration of an alternate embodiment of the EGR cooler and the associated control system components of FIG. 5, showing details thereof.

Referring now to FIG. 7, an alternate embodiment of EGR cooler 120 and associated control system components of system 125 of FIG. 5 is shown. The embodiment of FIG. 7 is identical in many respects to the embodiment of FIG. 6, and like reference numbers are therefore used to identify like components. Previously discussed components will not be discussed further for brevity.

The embodiment of EGR cooler 120 and associated control system components of FIG. 7 differ from that shown and described with respect to FIG. 6 in two areas, namely in the structure of EGR gas inlet control valves and in the partitioning of the EGR gas flow passages. In the embodiment of FIG. 7, any number of EGR gas flow control valves may be used to partition the EGR gas flow passages of EGR cooler 120 into a corresponding number of subsets thereof.

Referring to FIG. 7, EGR gas inlet port 122 leads to a throat portion 174 having a wall 176 therein which defines three gas flow passages therethrough. Three valves 178, 180 and 182 are connected to corresponding electronic actuators 184, 186 and 188 respectively. Actuator 184 is connected to output OUT3 of control system 126 via signal path 194, actuator 186 is connected to output OUT2 of control system 126 via signal path 192 and actuator 188 is connected to output OUT1 of control system 126 via signal path 190.

Each of the valves 178–182 may be individually pulled away from wall 176 under the control of control system 126, as illustrated by valve 182 in FIG. 7, to permit incoming EGR gas to flow through a corresponding gas flow passage defined in wall 176 and into a subset of EGR gas flow passages 162 defined within housing 160 of EGR cooler 120. Additionally, each of the valves 178–182 may be individually advanced toward wall 176 under the control of control system 126, into sealing engagement with a corresponding EGR gas flow passageway defined therein, as illustrated in FIG. 7 by valves 178 and 180. In the advanced position, each valve is operable to disable EGR gas from flowing through a corresponding partitioned subset of EGR gas flow passages 162.

The embodiment illustrated in FIG. 7 is nearly identical to the embodiment shown in FIG. 6 in that control system 126 is operable to control the surface area of EGR cooler 120 that is exposed to EGR gas in accordance with temperature, EGR flow rate and/or engine operating condition signals as described hereinabove. In the embodiment of FIG. 7, control system 126 does so by selectively withdrawing and advancing any of valves 178–182 to thereby effectively control the heat exchange capability of EGR cooler 120.

Figure 8A:
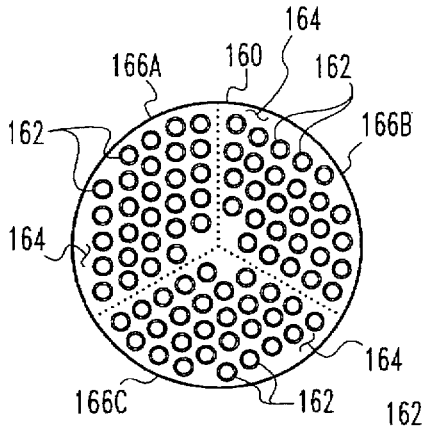
FIG. 8A is a cross-sectional view showing one embodiment of the internal structure of the EGR cooler of FIG. 7, viewed along section lines 8—8.

While the embodiment illustrated in FIG. 7 is shown as having three flow control valves 178–182, it is to be understood that the present invention contemplates partitioning the number of EGR gas flow passages 162 into any number of subsets, thereby requiring any corresponding number of flow control valves. In FIG. 7, three such flow control valves 178–182 are shown and the number of EGR gas flow passages 162 are therefore partitioned into Three separate subsets. Referring to FIG. 8A, one preferred partitioning scheme partitions the number of EGR gas flow passages 162 into three approximately equal subsets 166A, 166B and 166C thereof. Within each subset, areas 164 about EGR gas flow passages 162 define an EGR coolant flow path, if such an EGR fluid source 62 is provided. Referring to FIG. 8B, an alternate partitioning scheme partitions the number of EGR gas flow passages 162 into three subsets 168A, 168B and 168C having unequal numbers of EGR gas flow passages herein.

Figure 8C:
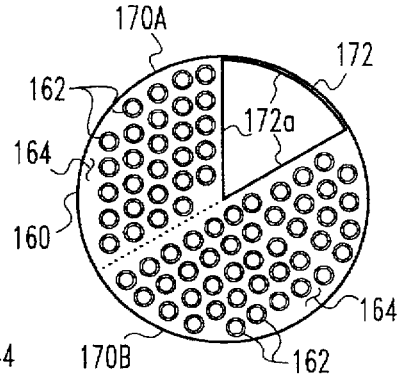
FIG. 8C is a cross-sectional view showing the internal structure of yet another embodiment of the EGR cooler of FIG. 7, viewed along section lines 8—8.
Figure 8B:
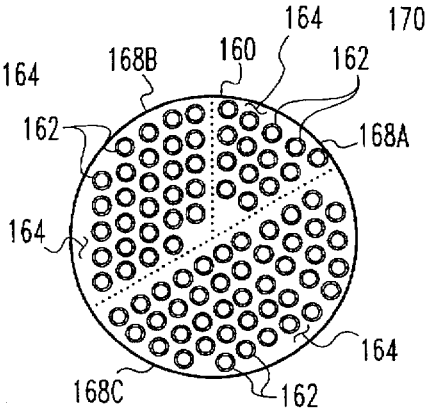
FIG. 8B is a cross-sectional view showing the internal structure of another embodiment of the EGR cooler of FIG. 7, viewed along section lines 8—8.

Referring now to FIG. 8C, the present invention contemplates substituting at least one subset of EGR gas flow passages 162 with an EGR gas bypass channel 172 defined by walled portion 172*a*, leaving the number of EGR gas flow passages 162 to be partitioned into two equal or unequal subsets 170A and 170B. In the embodiment shown in FIG. 8C, bypass channel 172 defines a very low effectiveness EGR gas cooling path through the cooler 120, with a similarly low pressure drop therethrough, so that the temperature and pressure of EGR gas flowing therethrough is only minimally affected. In accordance with another aspect of the present invention, control system 126 is operable, under light engine load conditions, to disable EGR gas from flowing through subsets 170A and 170B and direct all of the EGR gas through bypass channel 172, thereby effectively bypassing the cooling effect of EGR cooler 120 and thereby avoiding fouling and condensation of cooler 120 as well as the downstream mechanical components. Under heavier engine load conditions, control system 126 is operable to selectively enable EGR gas flow through subsets 170A and/or 170B. As with the previous embodiments discussed hereinabove, control system 126 is operable to control EGR gas flow through any of the partitioning arrangements shown in FIGS. 8A–8C in response to temperature signals from any of temperature sensors 90–102, or in response to either engine operating parameters and/or sensed EGR gas flow rate conditions as discussed hereinabove. As with the partitioning embodiment shown in FIG. 6A, it is to be understood that the dashed-line partition segments in FIGS. 8A–8C are provided for, illustration only, and do not represent any wall structure within cooler 120.

With any of tile partitioning structures of FIGS. 8A–8C, the present invention contemplates that the EGR gas flow control valve 28 of FIG. 5 may be omitted, so that control system 126 may simultaneously control the flow rate and temperature of EGR gas provided to intake manifold 14 of engine 12 through control of valves 178–182. Such an arrangement would not only provide for a high level of active control over the temperature of EGR gas provided at outlet 124, with all the benefits thereof described herein, but would further obviate the need for the expensive and space consuming EGR gas flow control valve 28.

Figure 9A:
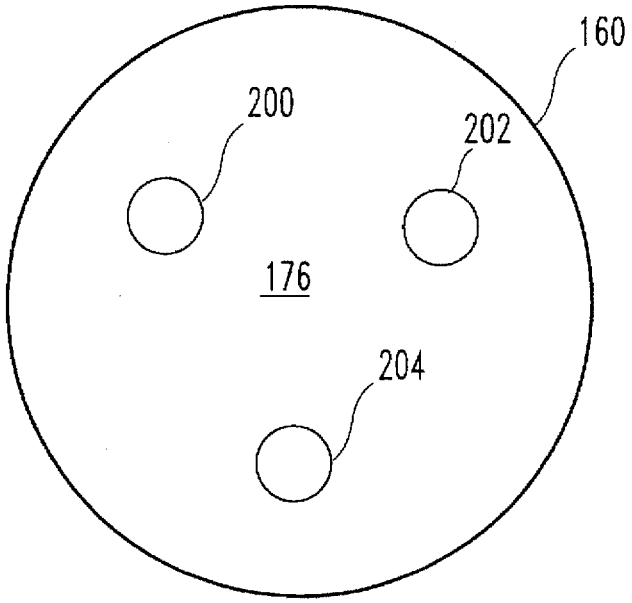
FIG. 9A is a cross-sectional view showing one embodiment of the valve engaging wall of the EGR cooler of FIG. 7, viewed along section lines 9—9.
Figure 9B:
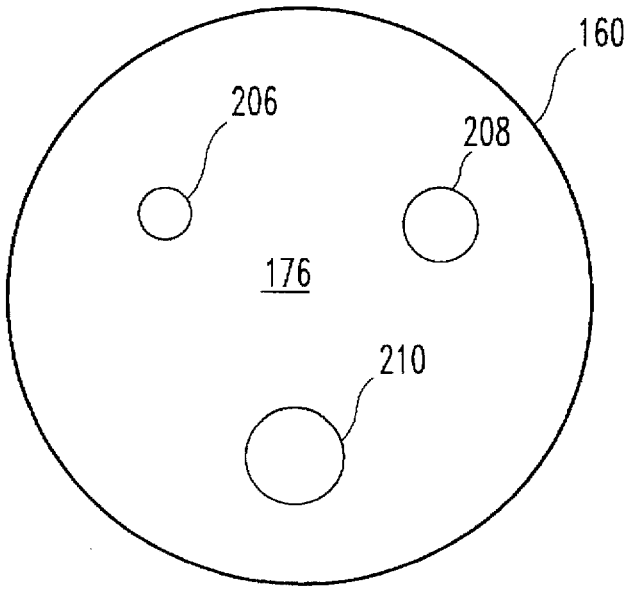
FIG. 9B is a cross-sectional view showing an alternate embodiment of the valve engaging wall of the EGR cooler of FIG. 7, viewed along section lines 9—9.

Referring to FIG. 9A, one embodiment of valve engaging wall 176 of cooler 120 of FIG. 7 is shown. In the embodiment of FIG. 9A, wall 176 includes three identically sized bores 200, 202 and 204 therethrough, each of which are adapted to sealingly engage a corresponding one of valves 178, 180 and 182. In this embodiment, each of the bores 200–204 are configured to provide for an approximately equal gas flow rate therethrough. Referring to FIG. 98, an alternate embodiment of valve engaging wall 176 of cooler 120 of FIG. 7 is shown. In the embodiment of FIG. 9B, wall 176 includes three bores 206, 208 and 210 therethrough, wherein the widths of the bores as well as the width of the corresponding valves 178, 180 and 182 are graduated to provide for proportional flow of gas therethrough. Thus, the control system 126 may selectively actuate valves 178–182 as described hereinabove to provide for "trimming" of the EGR gas flow rate in response to degradation of cooler 120 or other sources of variability in EGR gas flow rate.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. For example, while the present invention has been described herein to some extent as being directed a motor vehicle application, and to one having a diesel engine specifically, it is to be understood that the present invention contemplates that the concepts described herein may be incorporated into any machine which includes an internal combustion engine. Further, it is to be understood that the present invention contemplates that any of the techniques separately described hereinabove may be combined to Form a combination EGR gas cooler and EGR gas flow rate controller so that an EGR flow rate control valve 28 may be omitted as unnecessary. For example, the partitioned cooler 120 of FIG. 7 may be used with either valve wall 176 embodiment to provide for controlled EGR gas temperature and flow rate. Similarly, the partitioned cooler 120 of FIG. 7 may be used with either valve wall 176 embodiment in conjunction with the coolant flow techniques described herein to provide for a high level of control over both EGR gas flow rate and EGR gas temperature. Other combinations of the various structures and techniques described herein will become apparent to those skilled in the art. It should further be noted that the term "engine operating parameter" as used herein should be understood to mean any of the EGR temperature sensor signals described herein, any of the EGR gas flow rate signals described herein and/or any of the engine operating parameters typically available in an electronically controlled engine and/or machine such as, for example, engine load, air intake manifold pressure, mass air flow rate, throttle percentage, engine RPM, engine fueling rate, and the like.

What is claimed is:

1. Apparatus for controlling the temperature of recirculated exhaust gas in an internal combustion engine, comprising:

a first conduit coupled at one end to an exhaust gas port of the engine;

a second conduit coupled at one end to an air inlet port of the engine;

a source of coolant fluid;

a heat exchanger including a housing defining a gas inlet port, a gas outlet port, a coolant inlet port and a coolant outlet port, said gas inlet port connected to an opposite end of said first conduit and receiving exhaust gas therefrom, said gas outlet port connected to an opposite end of said second conduit and supplying recirculated exhaust gas thereto, said coolant inlet port connected to said source of coolant fluid, said heat exchanger defining a coolant flow path therethrough from said source of coolant fluid to said coolant outlet port;

a coolant control valve disposed within said coolant flow path and operable to control a rate of coolant flow therethrough;

a temperature sensor operable to sense heat exchanger housing temperature and produce a temperature signal corresponding thereto; and an electronic control system responsive to said temperature signal to provide a coolant valve control signal corresponding thereto, said coolant control valve responsive to said coolant valve control signal to control said rate of coolant flow through said coolant flow path and thereby control said recirculated exhaust gas temperature.

2. The apparatus of claim 1 wherein said electronic control system is responsive to said temperature signal to determine said recirculated exhaust gas temperature therefrom and produce said coolant valve control signal in accordance with said recirculated exhaust gas temperature.

3. The apparatus of claim 1 wherein said temperature sensor is attached to an outer surface of said heat exchanger housing.

4. Apparatus for controlling the temperature of recirculated exhaust gas in an internal combustion engine, comprising:

a first conduit coupled at one end to an exhaust gas port of the engine;

a second conduit coupled at one end to an air inlet port of the engine;

a source of coolant fluid;

a heat exchanger including a gas inlet port connected to an opposite end of said first conduit and receiving exhaust gas therefrom, a gas outlet port connected to an opposite end of said second conduit and supplying recirculated exhaust gas thereto, a coolant inlet port connected to said source of coolant fluid and a coolant outlet port, said heat exchanger defining a coolant flow path therethrough from said source of coolant fluid to said coolant outlet port;

a coolant control valve disposed within said coolant flow path and operable to control a rate of coolant flow therethrough;

a first temperature sensor disposed within said coolant flow path and operable to produce a first temperature signal corresponding to coolant fluid temperature entering said heat exchanger;

a second temperature sensor disposed within said coolant flow path and operable to produce a second temperature signal corresponding to coolant fluid temperature exiting said heat exchanger; and an electronic control system responsive to said first and second temperature signals to provide a coolant valve control signal corresponding thereto, said coolant control valve responsive to said coolant valve control signal to control said rate of coolant flow through said coolant flow path and thereby control said recirculated exhaust gas temperature.

5. The apparatus of claim 4 wherein said electronic control system is responsive to said first and second temperature signals to determine said recirculated exhaust gas temperature therefrom and produce said coolant valve control signal in accordance with said recirculated exhaust gas temperature.

6. Apparatus for controlling the temperature of recirculated exhaust gas in an internal combustion engine, comprising:

a first conduit coupled at one end to an exhaust gas port of the engine;

a second conduit coupled at one end to an air inlet port of the engine;

a heat exchanger including a gas inlet port connected to an opposite end of said first conduit and receiving exhaust gas therefrom, a gas outlet port connected to an opposite end of said second conduit and supplying recirculated exhaust gas thereto, said heat exchanger defining a number of exhaust gas flow paths therethrough from said gas inlet port to said gas outlet port;

means for selectively disabling exhaust gas flow through certain ones of said number of exhaust gas flow paths; and means for controlling said means for selectively disabling exhaust gas flow through certain ones of said number of exhaust gas flow paths to thereby control the temperature of said recirculated exhaust gas.

7. The apparatus of claim 6 wherein said means for selectively disabling exhaust gas flow through certain ones of said number of exhaust gas flow paths includes a first exhaust gas control valve responsive to a first control signal to disable gas flow through a first subset of said number of exhaust gas flow paths to thereby vary said heat exchange capability of said heat exchanger.

8. The apparatus of claim 7 wherein said means for controlling said means for selectively disabling exhaust gas flow through certain ones of said number of exhaust gas flow paths includes means for determining recirculated exhaust gas temperature and producing said first control signal in accordance therewith to thereby control the temperature of said recirculated exhaust gas.

9. The apparatus of claim 7 wherein said means for controlling said means for selectively disabling exhaust gas flow through certain ones of said number of exhaust gas flow paths includes means for determining a flow rate of said recirculated exhaust gas and producing said first control signal in accordance therewith to thereby control the temperature of said recirculated exhaust gas.

10. The apparatus of claim 7 wherein said first subset of said number of exhaust gas flow paths includes approximately one half of said number of exhaust gas flow paths.

11. The apparatus of claim 7 wherein said means for selectively disabling exhaust gas flow through certain ones of said number of exhaust gas flow paths includes a second exhaust gas control valve responsive to a second control signal to disable gas flow through a second subset of said number of exhaust gas flow paths to thereby vary said heat exchange capability of said heat exchanger.

12. The apparatus of claim 11 wherein said means for controlling said means for selectively disabling exhaust gas flow through certain ones of said number of exhaust gas flow paths includes means for determining recirculated exhaust gas temperature and producing said first and second control signals in accordance therewith to thereby control the temperature of said recirculated exhaust gas.

13. The apparatus of claim 11 wherein said means for controlling said means for selectively disabling exhaust gas flow through certain ones of said number of exhaust gas flow paths includes means for determining a flow rate of said recirculated exhaust gas and producing said first and second control signals in accordance therewith to thereby control the temperature of said recirculated exhaust gas.

14. The apparatus of claim 11 wherein said means for selectively disabling exhaust gas flow through certain ones of said number of exhaust gas flow paths includes a third exhaust gas control valve responsive to a third control signal to disable gas flow through a third subset of said number of exhaust gas flow paths to thereby vary said heat exchange capability of said heat exchanger.

15. The apparatus of claim 14 wherein said means for controlling said means for selectively disabling exhaust gas flow through certain ones of said number of exhaust gas flow paths includes means for determining recirculated exhaust gas temperature and producing said first, second and third control signals in accordance therewith to thereby control the temperature of said recirculated exhaust gas.

16. The apparatus of claim 14 wherein said means for controlling said means for selectively disabling exhaust gas flow through certain ones of said number of exhaust gas flow paths includes means for determining a flow rate of said recirculated exhaust gas and producing said first, second and third control signals in accordance therewith to thereby control the temperature of said recirculated exhaust gas.

17. The apparatus of claim 14 wherein each of said first, second and third subsets of said number of exhaust gas flow paths include approximately an equal number of exhaust gas flow paths.

18. The apparatus of claim 14 wherein said first, second and third subsets of said number of exhaust gas flow paths include unequal numbers of exhaust gas flow paths.

19. The apparatus of claim 11 wherein said heat exchanger defines a gas bypass channel therethrough from said gas inlet port to said gas outlet port, said gas bypass channel providing for exhaust gas flow therethrough with a minimal effect on the temperature of the exhaust gas;

and wherein said means for selectively disabling exhaust gas flow through certain ones of said number of exhaust gas flow paths further includes a third exhaust gas control valve responsive to a third control signal to enable gas flow through a said gas bypass channel.

20. The apparatus of claim 19 wherein said means for controlling said means selectively disabling exhaust gas flow through certain ones of said number of exhaust gas flow paths includes means for determining recirculated exhaust gas temperature and producing said first, second and third control signals in accordance therewith to thereby control the temperature of said recirculated exhaust gas.

21. The apparatus of claim 19 wherein said means for controlling said means for selectively disabling exhaust gas flow through certain ones of said number of exhaust gas flow paths includes means for determining a flow rate of said recirculated exhaust gas and producing said first, second and third control signals in accordance therewith to thereby control the temperature of said recirculated exhaust gas.

22. The apparatus of claim 19 wherein said first, second and third exhaust gas control valves are responsive to said first, second and third control signals to direct air flow through desired ones of said first and second subsets of said gas flow paths and said gas bypass channel to simultaneously vary said heat exchange capability of said heat exchanger and modulate a flow rate of said recirculated exhaust gas to said air inlet port of the engine.

23. The apparatus of claim 22 wherein said means for controlling said means for selectively disabling exhaust gas flow through certain ones of said number of exhaust gas flow paths includes means for determining recirculated exhaust gas temperature and producing said first, second and third control signals in accordance therewith to thereby control the temperature of said recirculated exhaust gas.

24. The apparatus of claim 22 wherein said means for controlling said means for selectively disabling exhaust gas flow through certain ones of said number of exhaust gas flow paths includes means for determining a flow rate of said recirculated exhaust gas and producing said first, second and third control signals in accordance therewith to thereby control the temperature of said recirculated exhaust gas.

25. Apparatus for controlling the temperature of recirculated exhaust gas in an internal combustion engine, comprising:

a source of coolant fluid;

a heat exchanger including a housing defining a gas inlet port, a gas outlet port, a coolant inlet port and a coolant outlet port, said gas inlet port coupled an exhaust gas port of the engine, a gas outlet port coupled to an air intake port of the engine, a coolant inlet port connected to said source of coolant fluid and a coolant outlet port, said heat exchanger defining a coolant flow path therethrough from said source of coolant fluid to said coolant outlet port;

a coolant control valve disposed within said coolant flow path and operable to control a rate of coolant flow therethrough;

a temperature sensor operable to sense heat exchanger housing temperature and produce a temperature signal corresponding thereto; and an electronic control system responsive to said temperature signal to provide a coolant valve control signal corresponding thereto, said coolant control valve responsive to said coolant valve control signal to control said rate of coolant flow through said coolant flow path and thereby control said recirculated exhaust gas temperature.

26. The apparatus of claim 25 wherein said electronic control system is responsive to said temperature signal to determine said recirculated exhaust gas temperature therefrom and produce said coolant valve control signal in accordance with said recirculated exhaust gas temperature.

27. The apparatus of claim 26 wherein said temperature sensor is attached to an outer surface of said heat exchanger housing.

28. Apparatus for controlling the temperature of recirculated exhaust gas in an internal combustion engine, comprising:

a source of coolant fluid;

a heat exchanger receiving exhaust gas from an exhaust gas port of the engine and providing recirculated exhaust gas to an air intake port of the engine, said heat exchanger defining a coolant flow path therethrough and having a coolant control valve operable to control a rate of coolant fluid flow through said flow path from said source of coolant fluid;

a first temperature sensor disposed within said coolant flow path and operable to produce a first temperature signal corresponding to coolant fluid temperature entering said heat exchanger;

a second temperature sensor disposed within said coolant flow path and operable to produce a second temperature signal corresponding to coolant fluid temperature exiting said heat exchanger; and an electronic control system responsive to said first and second temperature signals to provide a coolant valve control signal corresponding thereto, said coolant control valve responsive to said coolant valve control signal to control said rate of coolant flow through said coolant flow path and thereby control said recirculated exhaust gas temperature.

29. The apparatus of claim 28 wherein said electronic control system is responsive to said first and second temperature signals to determine said recirculated exhaust gas temperature therefrom and produce said coolant valve control signal in accordance with said recirculated exhaust gas temperature.

30. Apparatus for controlling the temperature of recirculated exhaust gas in an internal combustion engine, comprising:

a heat exchanger having a gas inlet port receiving exhaust gas from an exhaust gas port of the engine and a gas outlet port supplying recirculated exhaust gas to an air intake port of the engine, said heat exchanger defining a number of exhaust gas flow paths therethrough from said gas inlet port to said gas outlet port and having a first exhaust gas control valve responsive to a first control signal to selectively disable exhaust gas flow through certain ones of said number of exhaust gas flow paths; and means for producing said first control signal to thereby control said recirculated exhaust gas temperature.

31. The apparatus of claim 30 wherein said first exhaust gas control valve is responsive to said first control signal to disable gas flow through a first subset of said number of exhaust gas flow paths to thereby vary said heat exchange capability of said heat exchanger.

32. The apparatus of claim 31 wherein said first subset of said number of exhaust gas flow paths includes approximately one half of said number of exhaust gas flow paths.

33. The apparatus of claim 31 wherein said means for producing said first control signal includes means for determining recirculated exhaust gas temperature and producing said first control signal in accordance therewith to thereby control the temperature of said recirculated exhaust gas.

34. The apparatus of claim 33 wherein said means for determining recirculated exhaust gas temperature includes:

a temperature sensor disposed within said recirculated exhaust gas, said temperature sensor producing a temperature signal corresponding to said recirculated exhaust gas temperature; and an electronic control system responsive to said temperature signal to produce said first control signal.

35. The apparatus of claim 34 wherein said temperature sensor is disposed within said gas outlet port of said heat exchanger.

36. The apparatus of claim 33 wherein said heat exchanger includes a housing defining said gas inlet port and said gas outlet port, and housing said number of exhaust gas flow paths therein;

and wherein said means for determining recirculated exhaust gas temperature includes:

a temperature sensor operable to sense heat exchanger housing temperature and produce a temperature signal corresponding thereto; and an electronic control system responsive to said temperature signal to produce said first control signal.

37. The apparatus of claim 36 wherein said temperature sensor is attached to an outer surface of said heat exchanger housing.

38. The apparatus of claim 31 wherein said means for producing said first control signal includes means for determining a flow rate of said recirculated exhaust gas and producing said first control signal in accordance therewith to thereby control the temperature of said recirculated exhaust gas.

39. The apparatus of claim 38 wherein said means for determining a flow rate of said recirculated gas includes:

a pressure sensor disposed within said recirculated exhaust gas, said pressure sensor producing a gas pressure signal corresponding to pressure of said recirculated exhaust gas; and an electronic control system responsive to said pressure signal to compute an exhaust gas flow rate and produce said first control signal in accordance therewith.

40. The apparatus of claim 39 wherein said pressure sensor is disposed within said gas outlet port of said heat exchanger.

41. The apparatus of claim 31 further including a second exhaust gas control valve responsive to a second control signal to disable gas flow through a second subset of said number of exhaust gas flow paths to thereby vary said heat exchange capability of said heat exchanger; and wherein said means for producing said first control signal includes means for producing said second control signal.

42. The apparatus of claim 41 further including a third exhaust gas control valve responsive to a third control signal to disable gas flow through a third subset of said number of exhaust gas flow paths to thereby vary said heat exchange capability of said heat exchanger; and wherein said means for producing said first and second control signals includes means for producing said third control signal.

43. The apparatus of claim 42 wherein said means for producing said first, second and third control signals includes means for determining recirculated exhaust gas temperature and producing said first, second and third control signals in accordance therewith to thereby control the temperature of said recirculated exhaust gas.

44. The apparatus of claim 43 wherein said means for determining recirculated exhaust gas temperature includes:

a temperature sensor disposed within said recirculated exhaust gas, said temperature sensor producing a temperature signal corresponding to said recirculated exhaust gas temperature; and an electronic control system responsive to said temperature signal to produce said first, second and third control signals.

45. The apparatus of claim 44 wherein said temperature sensor is disposed within said gas outlet port of said heat exchanger.

46. The apparatus of claim 43 wherein said heat exchanger includes a housing defining said gas inlet port and said gas outlet port, and housing said number of exhaust gas flow paths therein;

and wherein said means for determining recirculated exhaust gas temperature includes:

a temperature sensor operable to sense heat exchanger housing temperature and produce a temperature signal corresponding thereto; and an electronic control system responsive to said temperature signal to produce said first, second and third control signals.

47. The apparatus of claim 46 wherein said temperature sensor is attached to an outer surface of said heat exchanger housing.

48. The apparatus of claim 42 wherein said means for producing said first, second and third control signals includes means for determining a flow rate of said recirculated exhaust gas and producing said first, second and third control signals in accordance therewith to thereby control the temperature of said recirculated exhaust gas.

49. The apparatus of claim 48 wherein said means for determining a flow rate of said recirculated gas includes:

a pressure sensor disposed within said recirculated exhaust gas, said pressure sensor producing a gas pressure signal corresponding to pressure of said recirculated exhaust gas; and an electronic control system responsive to said pressure signal to compute an exhaust gas flow rate and produce said first, second and third control signals in accordance therewith.

50. The apparatus of claim 49 wherein said pressure sensor is disposed within said gas outlet port of said heat exchanger.

51. The apparatus of claim 42 wherein each of said first, second and third subsets of said number of exhaust gas flow paths include approximately an equal number of exhaust gas flow paths.

52. The apparatus of claim 42 wherein said first, second and third subsets of said number of exhaust gas flow paths include unequal numbers of exhaust gas flow paths.

53. The apparatus of claim 41 wherein said heat exchanger defines a gas bypass channel therethrough from said gas inlet port to said gas outlet port, said gas bypass channel bypassing providing for exhaust gas flow therethrough with a minimal effect on the temperature of the exhaust gas;

and further including a third exhaust gas control valve responsive to a third control signal to enable gas flow through a said gas bypass channel;

and wherein said means for producing said first and second control signals includes means for producing said third control signal.

54. The apparatus of claim 53 wherein said means for producing said first, second and third control signals includes means for determining recirculated exhaust gas temperature and producing said first, second and third control signals in accordance therewith to thereby control the temperature of said recirculated exhaust gas.

55. The apparatus of claim 53 wherein said means for producing said first, second and third control signals includes means for determining a flow rate of said recirculated exhaust gas and producing said first, second and third control signals in accordance therewith to thereby control the temperature of said recirculated exhaust gas.

56. The apparatus of claim 53 wherein said first, second and third exhaust gas control valves are responsive to said first, second and third control signals to direct air flow through desired ones of said first and second subsets of said gas flow paths and said gas bypass channel to simultaneously vary said heat exchange capability of said heat exchanger and modulate a flow rate of said recirculated exhaust gas to said air inlet port of the engine.

57. The apparatus of claim 56 wherein said means for producing said first, second and third control signals includes means for determining recirculated exhaust gas temperature and producing said first, second and third control signals in accordance therewith to thereby control the temperature of said recirculated exhaust gas.

58. The apparatus of claim 56 wherein said means for producing said first, second and third control signals includes means for determining a flow rate of said recirculated exhaust gas and producing said first, second and third control signals in accordance therewith to thereby control the temperature of said recirculated exhaust gas.

* * * * *

UNITED STATES PATENT AND TRADEMARK OFFICE

CERTIFICATE OF CORRECTION

PATENT NO : 5,732,688

DATED : Mar. 31, 1998

INVENTOR(S) : Steve J. Charlton, et al.

It is certified that error appears in the above-identified patent and that said Letters Patent is hereby corrected as shown below:

In Col. 5, at line 1, replace "tile" with --the--.

In Col. 12, at line 60, replace "Three" with --three--.

In Col. 13, at line 36, replace "tile" with --the--.

In Col. 14, at line 13, replace "Form" with --form--.

Signed and Sealed this

Twenty-third Day of June, 1998

Bruce Lehman

*Attest:*

BRUCE LEHMAN

*Attesting Officer*

*Commissioner of Patents and Trademarks*